US011317769B1

(12) United States Patent
Brown

(10) Patent No.: US 11,317,769 B1
(45) Date of Patent: May 3, 2022

(54) TOILET SEAT ASSEMBLY

(71) Applicant: Johnny Brown, Midlothian, VA (US)

(72) Inventor: Johnny Brown, Midlothian, VA (US)

( * ) Notice: Subject to any disclaimer, the term of this patent is extended or adjusted under 35 U.S.C. 154(b) by 0 days.

(21) Appl. No.: 17/088,327

(22) Filed: Nov. 3, 2020

(51) Int. Cl.
*A47K 13/00* (2006.01)

(52) U.S. Cl.
CPC ..... *A47K 13/005* (2013.01)

(58) Field of Classification Search
CPC ..... A47K 13/005; A47K 13/06
USPC ..... 4/234, 235, 239
See application file for complete search history.

(56) References Cited

U.S. PATENT DOCUMENTS 54,480 A * 5/1866 Alexander ..... A47K 13/06 4/235
3,786,522 A 1/1974 Kira
4,145,767 A * 3/1979 Ibel ..... A47K 3/26 4/235
4,461,046 A 7/1984 Adams
5,448,781 A 9/1995 Miller
5,797,148 A * 8/1998 Kivela ..... A47K 17/026 4/235
6,449,780 B1 9/2002 Merry
D491,644 S 6/2004 Laguera Garza et al.
7,146,655 B2 12/2006 Karnopp
9,204,768 B2 * 12/2015 Green ..... A47K 13/005
9,848,744 B1 * 12/2017 Hobbs ..... A47K 13/005
2005/0022294 A1 2/2005 Laguera Garza

FOREIGN PATENT DOCUMENTS

WO WO2005011552 2/2005

* cited by examiner

*Primary Examiner* — Tuan N Nguyen

(57) ABSTRACT

A toilet seat assembly includes a cover that is formed into a closed loop thereby facilitating the cover to be positioned on a rim of a toilet bowl. The cover has an outer diameter is greater than an outer diameter of the toilet bowl such that the cover extends outwardly beyond an outer edge of the rim. A first ring is hingedly coupled to the cover for having a user sit thereon. The first ring has an outside diameter equivalent to the outside diameter of the cover to accommodate an obese user. A second ring is hingedly coupled to the first ring for having the user sit thereon. A lid is hingedly coupled to the cover and the lid is positionable in a lowered position when the second ring is in the lowered position.

6 Claims, 6 Drawing Sheets

TOILET SEAT ASSEMBLY

DESCRIPTION OF RELATED ART INCLUDING INFORMATION DISCLOSED UNDER 37 CFR 1.97 AND 1.98

The prior art relates to toilet devices including a contoured toilet seat for aiding in defecation. The prior art discloses a variety of toilet seats that each has a pair of rings which each have different sized openings for adults or children. The prior art discloses a toilet seat that includes a pair of rings. The prior art discloses a toilet for obese users that is constructed with an increased width as compared to traditional toilets.

BRIEF SUMMARY OF THE INVENTION

An embodiment of the disclosure meets the needs presented above by generally comprising a cover that is formed into a closed loop thereby facilitating the cover to be positioned on a rim of a toilet bowl. The cover has an outer diameter is greater than an outer diameter of the toilet bowl such that the cover extends outwardly beyond an outer edge of the rim. A first ring is hingedly coupled to the cover for having a user sit thereon. The first ring has an outside diameter equivalent to the outside diameter of the cover to accommodate an obese user. A second ring is hingedly coupled to the first ring for having the user sit thereon. A lid is hingedly coupled to the cover and the lid is positionable in a lowered position when the second ring is in the lowered position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
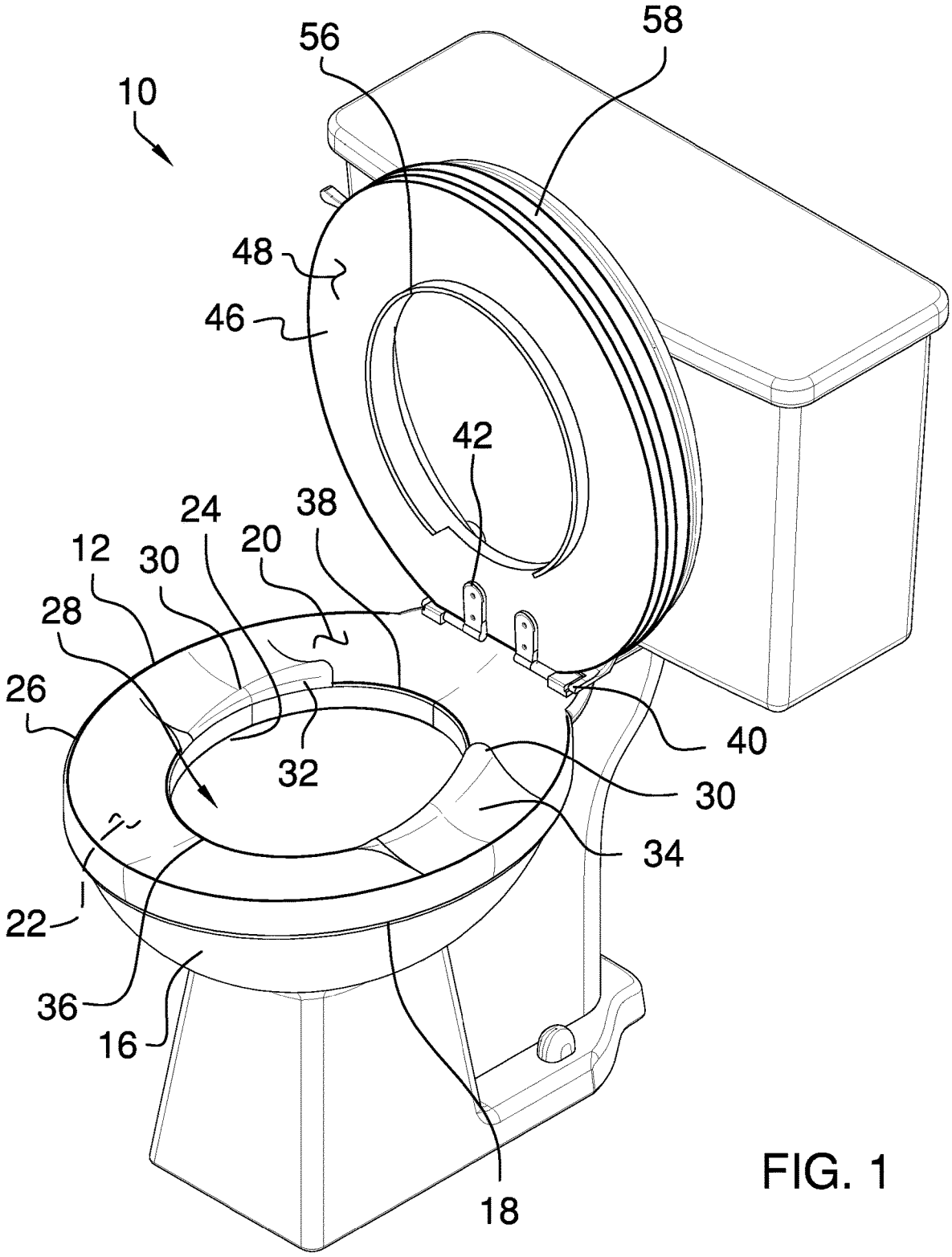
FIG. 1 is a top perspective view of a toilet seat assembly according to an embodiment of the disclosure.
Figure 2:
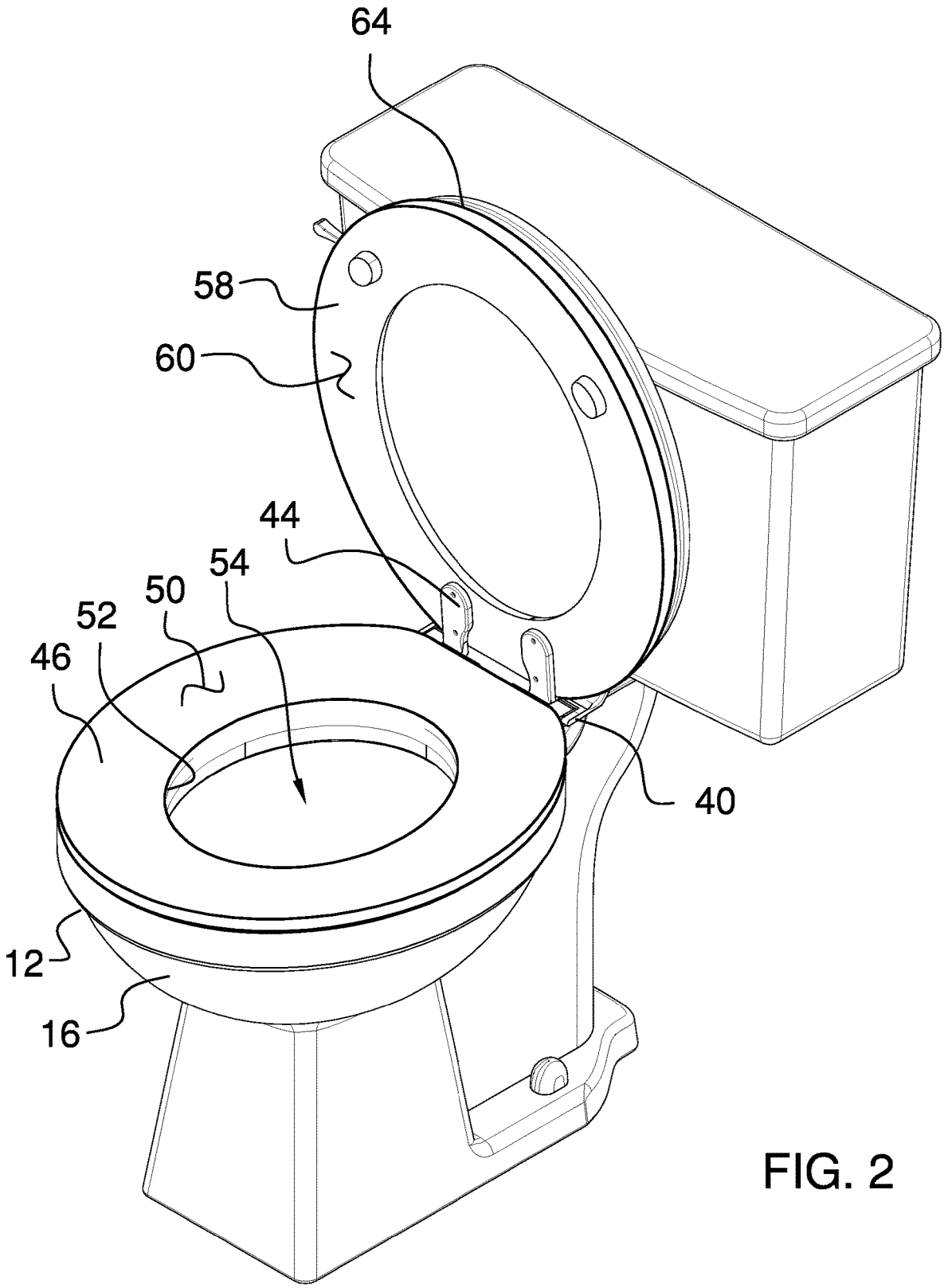
FIG. 2 is a top perspective view of an embodiment of the disclosure showing a first ring in a lowered position and a second ring in a raised position.
Figure 3:
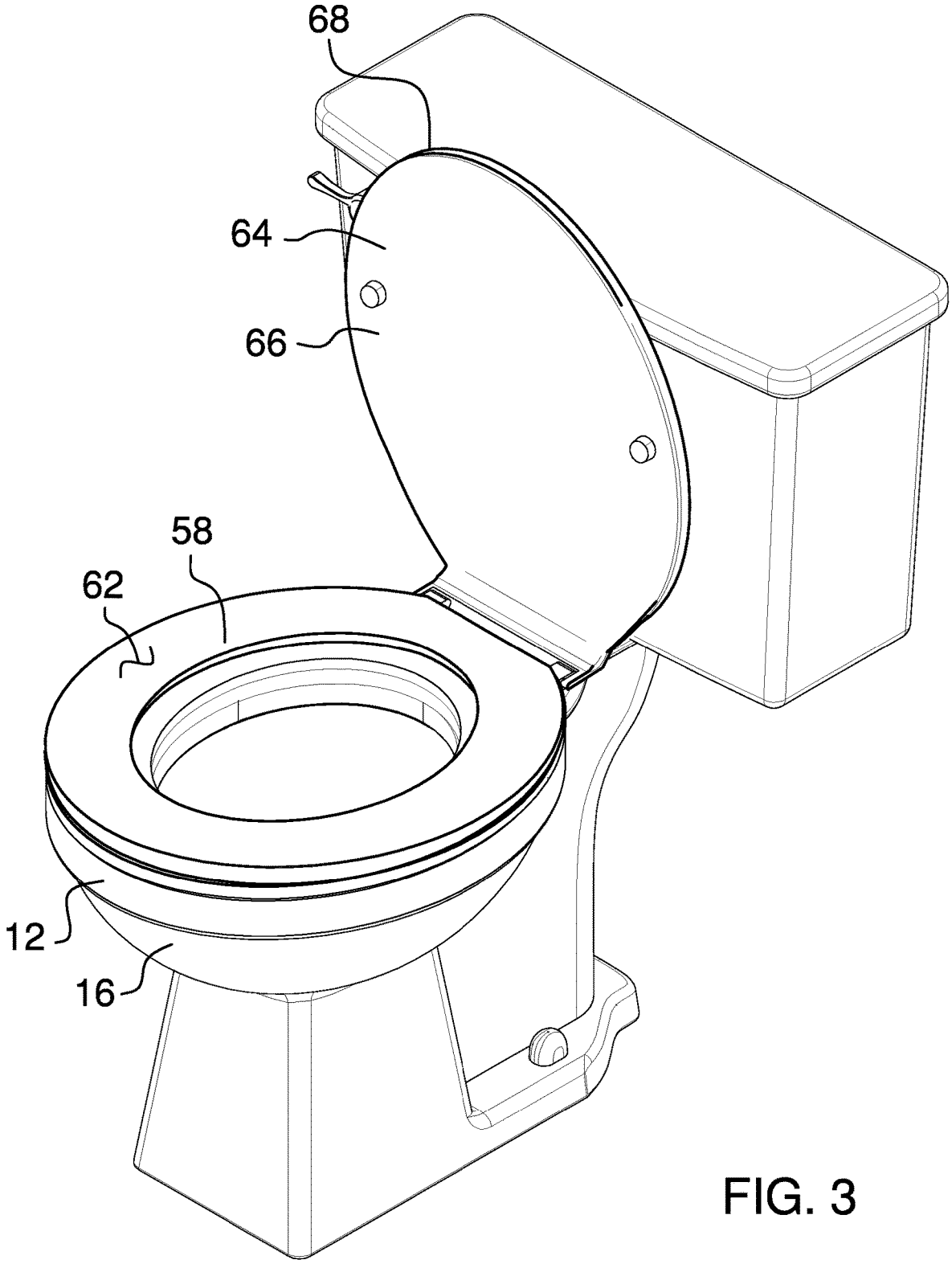
FIG. 3 is a top perspective view of an embodiment of the disclosure showing a second ring in a lowered position.
Figure 4:
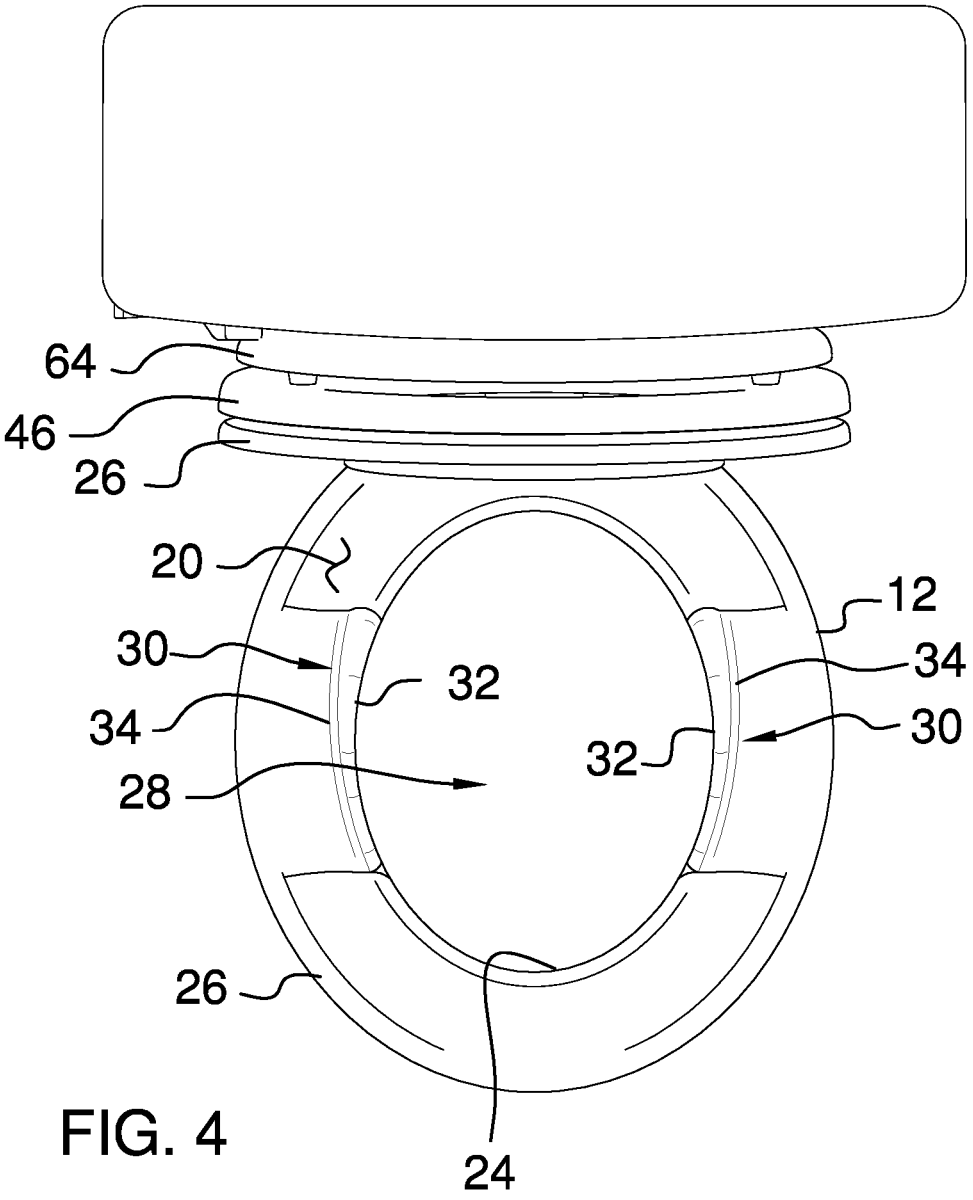
FIG. 4 is a top view of an embodiment of the disclosure.
Figure 5:
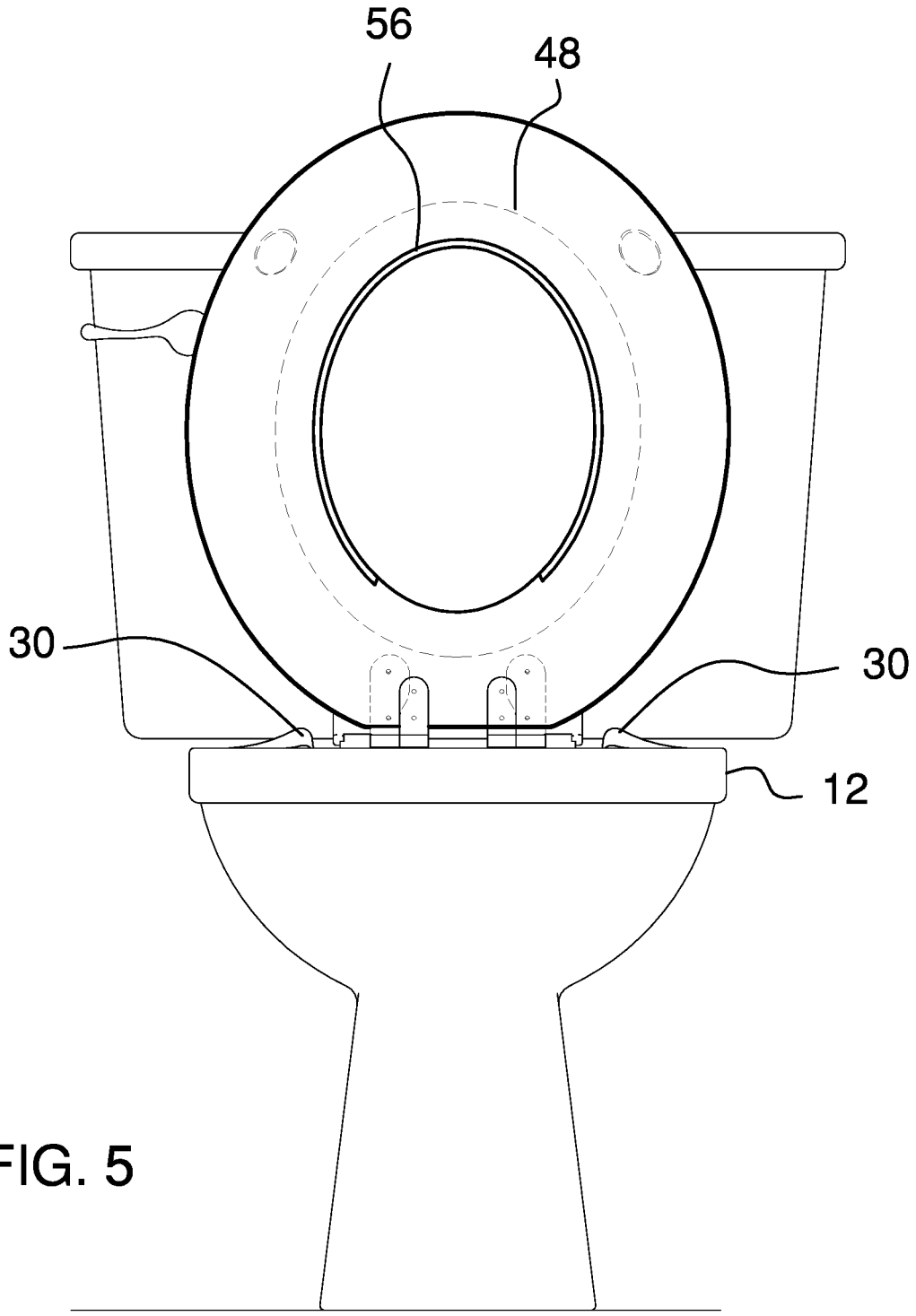
FIG. 5 is a front phantom view of an embodiment of the disclosure.
Figure 6:
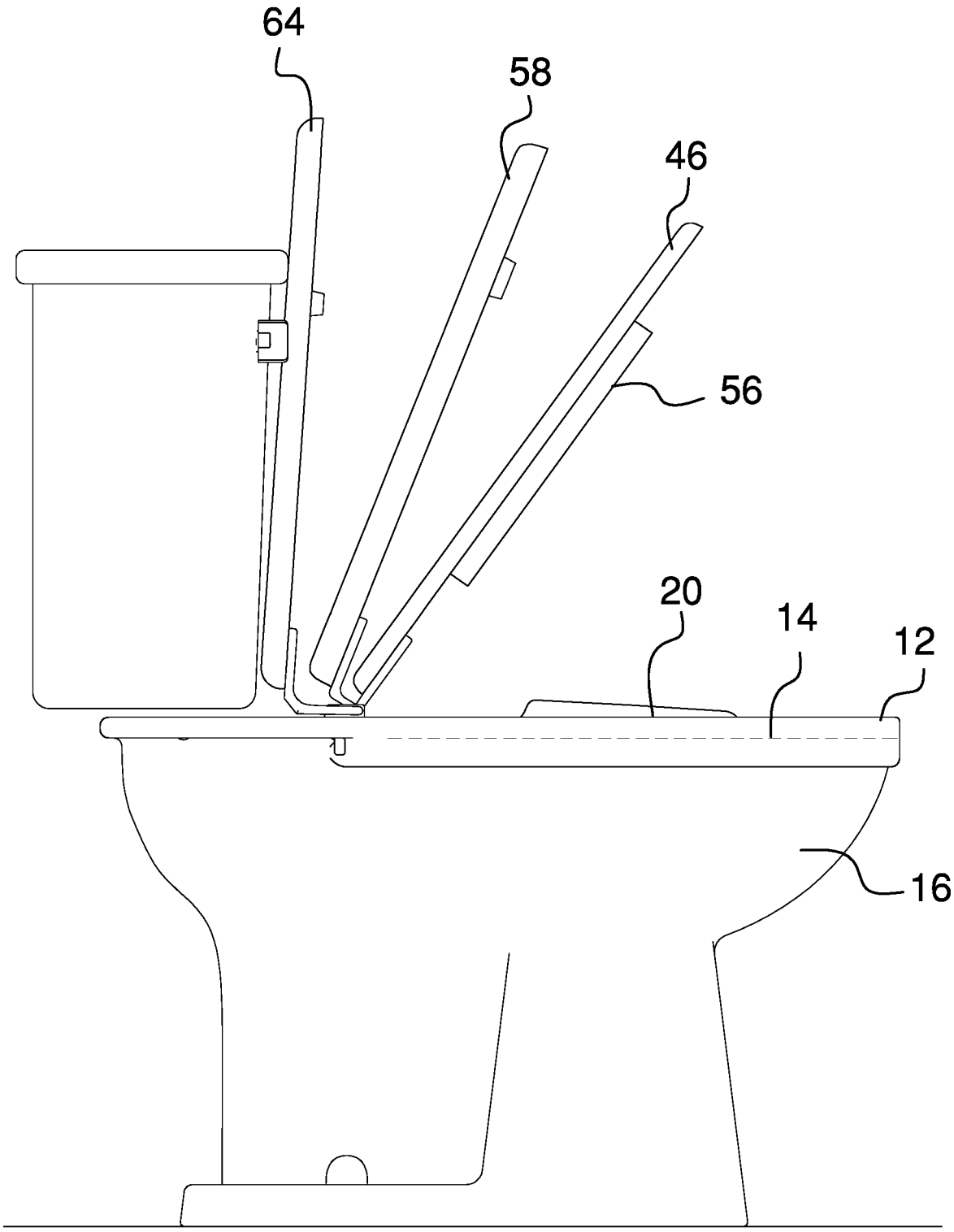
FIG. 6 is a perspective in-use view of an embodiment of the disclosure.

With reference now to the drawings, and in particular to FIGS. 1 through 6 thereof, a new toilet device embodying the principles and concepts of an embodiment of the disclosure and generally designated by the reference numeral 10 will be described.

As best illustrated in FIGS. 1 through 6, the toilet seat assembly 10 generally comprises a cover 12 that is formed into a closed loop thereby facilitating the cover 12 to be positioned on a rim 14 of a toilet bowl 16. The cover 12 has an outer diameter that is greater than an outer diameter of the toilet bowl 16 such that the cover 12 extends outwardly beyond an outer edge 18 of the rim 14. The toilet bowl 16 has a top surface 13 extending between an interior surface 15 and an exterior surface 17. The top surface 13 slopes downwardly between the interior surface 15 and the exterior surface 17. Additionally, the top surface 13 may slope downwardly a distance of approximately 0.75 inches.

The cover 12 has a top surface 20, a bottom surface 22, an inner edge 24 and an outer edge 26. The inner edge 24 defines an opening 28 extending through the cover 12 and the bottom surface 22 rests on the rim 14 of the toilet bowl 16. The cover 12 may be longitudinally elongated such that the cover 12 has an ovoid shape that conforms to ovoid toilet bowls. Additionally, the cover 12 may be attached to the toilet bowl 16 at an existing hinge point on the toilet bowl 16 with fasteners such as bolts or the like.

The top surface 20 has a pair of prominences 30 each sloping upwardly from the top surface 20. Each of the prominences 30 has a vertical face 32 that is aligned with the inner edge 24 of the cover 12. The prominences 30 are positioned on opposite sides of the opening 28 defined by the inner edge 24. Each of the prominences 30 has a sloped face 34 which slopes upwardly between the top surface 20 of the cover 12 and the vertical face 32. Moreover, the vertical face 32 of each of the prominences 30 increases in height between a front side 36 of the opening 28 and a back side 38 of the opening 28. A hinge 40 is coupled to the top surface 20 of the cover 12, and the hinge 40 has a first portion 42 and a second portion 44. Each of the first portion 42 and the second portion 44 are rotatable independently of each other.

A first ring 46 is provided and the first ring 46 is hingedly coupled to the cover 12. The first ring 46 is positionable in a lowered position having the first ring 46 lying on the cover 12 for a user to sit upon. The first ring 46 is positionable in a raised position having the first ring 46 extending upwardly from the cover 12. The first ring 46 has an outside diameter that is equivalent to the outside diameter of the cover 12. In this way the first ring 46 can accommodate an obese user thereby enhancing comfort for the obese user as compared to traditional toilet seats. The first ring 46 may be longitudinally elongated such that the first ring 46 has an ovoid shape that conforms to the shape of the cover 12.

The first ring 46 has a lower surface 48, an upper surface 50 and an inside edge 52. Additionally, the inside edge 52 defines an opening 54 extending through the first ring 46. The lower surface 48 is hingedly coupled to the first portion 42 of the hinge and the lower surface 48 has a lip 56 extending downwardly therefrom. The lip 56 is aligned with and is coextensive with the inside edge 52 to inhibit water from splashing between the first ring 46 and the cover 12 when the first ring 46 is in the lowered position.

A second ring 58 is provided that is hingedly coupled to the first ring 46. The second ring 58 is positionable in a lowered position when the first ring 46 is in the lowered position having the second ring 58 lying on the first ring 46. In this way the user can sit on the second ring 58. The second ring 58 is positionable in a raised position having the second ring 58 extending upwardly from the cover 12. The second ring 58 has a lower surface 60 and an upper surface 62, and the lower surface 60 of the second ring 58 is coupled to the second portion 44 of the hinge 40. Moreover, the lower surface 48 of the second ring 58 lies on the upper surface 50 of the first ring 46 when the second ring 58 is in the lowered position. The second ring 58 may be longitudinally elongated such that the second ring 58 has an ovoid shape that conforms to the shape of the first ring 46.

A lid 64 is provided and the lid 64 is hingedly coupled to the cover 12. The lid 64 is positionable in a lowered position when the second ring 58 is in the lowered position. Conversely, the lid 64 is positionable in a raised position having the lid 64 extending upwardly from the cover 12. The lid 64 has a bottom side 66 and an outer edge 68, and the outer edge 68 is hingedly coupled to the hinge 40. The bottom side 66 lies on the upper surface 50 of the second ring 58 when the lid 64 is in the lowered position.

In use, the cover 12 is attached to the rim 14 of the toilet bowl 16 for retaining the first ring 46, the second ring 58 and the lid 64 on the toilet bowl 16. The first ring 46 is positioned in the lowered position to inhibit water from splashing out of the toilet bowl 16. The second ring 58 is positioned in the lowered position to facilitate an obese user to sit on the toilet bowl 16. The second ring 46 has a large diameter that enhances comfort for the obese user as compared to existing toilet seats. Additionally, the lid 64 can be positioned in the lowered position when the toilet bowl 16 is not being used.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toilet seat assembly for facilitating an obese user to sit on a regularly sized toilet, said assembly comprising:

a cover being formed into a closed loop thereby facilitating said cover to be positioned on a rim of a toilet bowl, said cover having an outer diameter being greater than an outer diameter of the toilet bowl such that said cover extends outwardly beyond an outer edge of the rim, wherein said cover has a top surface, a bottom surface, an inner edge and an outer edge, said inner edge defining an opening extending through said cover, said bottom surface resting on the rim of the toilet bowl, said top surface having a pair of prominences each sloping upwardly from said top surface, wherein each of said prominences has a vertical face being aligned with said inner edge of said cover, said prominences being positioned on opposite sides of said opening defined by said inner edge, each of said prominences having a sloped face sloping upwardly between said top surface of said cover and said vertical face, said vertical face of each of said prominences increasing in height between a front side of said opening and a back side of said opening;

a first ring being hingedly coupled to said cover, said first ring being positionable in a lowered position having said first ring lying on said cover wherein said first ring is configured to have a user sit thereon, said first ring being positionable in a raised position having said first extending upwardly from said cover, said first ring has an outside diameter being equivalent to said outside diameter of said cover wherein said first ring is configured to accommodate an obese user;

a second ring being hingedly coupled to said first ring, said second ring being positionable in a lowered position when said first ring is in said lowered position having said second ring lying on said first ring wherein said second ring is configured to have the user sit thereon, said second ring being positionable in a raised position having said second ring extending upwardly from said cover; and a lid being hingedly coupled to said cover, said lid being positionable in a lowered position when said second ring is in said lowered position, said lid being positionable in a raised position having said lid extending upwardly from said cover.

2. The assembly according to claim 1, further comprising a hinge being coupled to said top surface of said cover, said hinge having a first portion and a second portion.

3. The assembly according to claim 2, wherein said first ring has a lower surface, an upper surface and an inside edge, said inside edge defining an opening extending through said first ring, said lower surface being hingedly coupled to said first portion of said hinge, said lower surface having a lip extending downwardly therefrom, said lip being aligned with and being coextensive with said inside edge wherein said lip is configured to inhibit water from splashing between said first ring and said cover when said first ring is in said lowered position.

4. The assembly according to claim 3, wherein said second ring has a lower surface and an upper surface, said lower surface of said second ring being coupled to said second portion of said hinge, said lower surface of said second ring lying on said upper surface of said first ring when said second ring is in said lowered position.

5. The assembly according to claim 4, wherein said lid has a bottom side and an outer edge, said bottom side lying on said upper surface of said second ring when said lid is in said lowered position.

6. A toilet seat assembly for facilitating an obese user to sit on a regularly sized toilet, said assembly comprising:

a cover being formed into a closed loop thereby facilitating said cover to be positioned on a rim of a toilet bowl, said cover having an outer diameter being greater than an outer diameter of the toilet bowl such that said cover extends outwardly beyond an outer edge of the rim, said cover having a top surface, a bottom surface, an inner edge and an outer edge, said inner edge defining an opening extending through said cover, said bottom surface resting on the rim of the toilet bowl, said top surface having a pair of prominences each sloping upwardly from said top surface, each of said prominences having a vertical face being aligned with said inner edge of said cover, said prominences being positioned on opposite sides of said opening defined by said inner edge, each of said prominences having a sloped face sloping upwardly between said top surface of said cover and said vertical face, said vertical face of each of said prominences increasing in height between a front side of said opening and a back side of said opening;

a hinge being coupled to said top surface of said cover, said hinge having a first portion and a second portion;

a first ring being hingedly coupled to said cover, said first ring being positionable in a lowered position having said first ring lying on said cover wherein said first ring is configured to have a user sit thereon, said first ring being positionable in a raised position having said first extending upwardly from said cover, said first ring having an outside diameter being equivalent to said outside diameter of said cover wherein said first ring is configured to accommodate an obese user, said first ring having a lower surface, an upper surface and an inside edge, said inside edge defining an opening extending through said first ring, said lower surface being hingedly coupled to said first portion of said hinge, said lower surface having a lip extending downwardly therefrom, said lip being aligned with and being coextensive with said inside edge wherein said lip is configured to inhibit water from splashing between said first ring and said cover when said first ring is in said lowered position;

a second ring being hingedly coupled to said first ring, said second ring being positionable in a lowered position when said first ring is in said lowered position having said second ring lying on said first ring wherein said second ring is configured to have the user sit thereon, said second ring being positionable in a raised position having said second ring extending upwardly from said cover, said second ring having a lower surface and an upper surface, said lower surface of said second ring being coupled to said second portion of said hinge, said lower surface of said second ring lying on said upper surface of said first ring when said second ring is in said lowered position; and a lid being hingedly coupled to said cover, said lid being positionable in a lowered position when said second ring is in said lowered position, said lid being positionable in a raised position having said lid extending upwardly from said cover, said lid having a bottom side and an outer edge, said outer edge being hingedly coupled to said hinge, said bottom side lying on said upper surface of said second ring when said lid is in said lowered position.

* * * * *